US011724914B2

(12) United States Patent
Vroegindeweij

(10) Patent No.: US 11,724,914 B2
(45) Date of Patent: Aug. 15, 2023

(54) RACK FOR A STAIRWAY GUIDE, AND A METHOD OF PROVIDING A STAIRWAY GUIDE COMPRISING A RACK

(71) Applicant: Devi-Group B.V., Obdam (NL)

(72) Inventor: Dennis Vroegindeweij, Obdam (NL)

(73) Assignee: Devi-Group B.V., Obdam (NL)

( * ) Notice: Subject to any disclaimer, the term of this patent is extended or adjusted under 35 U.S.C. 154(b) by 705 days.

(21) Appl. No.: 16/766,412

(22) PCT Filed: Nov. 26, 2018

(86) PCT No.: PCT/NL2018/050789
§ 371 (c)(1),
(2) Date: May 22, 2020

(87) PCT Pub. No.: WO2019/103612
PCT Pub. Date: May 31, 2019

(65) Prior Publication Data

US 2020/0361748 A1 Nov. 19, 2020

(30) Foreign Application Priority Data

Nov. 24, 2017 (NL) ..... 2019972

(51) Int. Cl.
*B66B 9/08* (2006.01)
*B66B 7/02* (2006.01)

(52) U.S. Cl.
CPC ..... *B66B 9/0815* (2013.01); *B66B 7/022* (2013.01); *B66B 7/023* (2013.01)

(58) Field of Classification Search
CPC ..... B66B 9/0815; B66B 9/0846; B66B 9/08; B66B 7/022; B66B 7/023
See application file for complete search history.

(56) References Cited

U.S. PATENT DOCUMENTS 4,627,517 A * 12/1986 Bor ..... B65G 35/00 414/595
5,230,405 A * 7/1993 Bartelt ..... B66B 9/0815 187/290

(Continued)

FOREIGN PATENT DOCUMENTS

NL 1030831 C1 7/2007
WO WO-2017105243 A1 * 6/2017 ..... B66B 9/0846
WO WO-2018036856 A1 * 3/2018 ..... B21D 47/01

OTHER PUBLICATIONS

International Search Report dated May 31, 2019 issued in connection with International Application No. PCT/NL2018/050789 with (3 pages total).

(Continued)

*Primary Examiner* — Michael A Riegelman
(74) *Attorney, Agent, or Firm* — Tatonetti IP

(57) ABSTRACT

A rack for a stairway guide suitable for providing good grip in curves comprises a bendable strip body, said bendable strip body comprising a first main side and a second main side, the first main side being provided with a series of equidistant engagement elements, each element being chosen from i) a hole, and ii) a protrusion. Both longitudinal sides are provided with a series of indentations. Being bendable, a stairway guide can be manufactured easily by bending the rack in the desired shape defined by the stairway guide.

6 Claims, 5 Drawing Sheets

(56) References Cited

U.S. PATENT DOCUMENTS 5,641,040 A * 6/1997 Grass ..... B66B 9/0815 187/245
6,098,342 A * 8/2000 Bischof ..... E05F 15/638 49/506
6,435,308 B2 * 8/2002 Grass ..... B66B 9/0815 198/321
6,712,192 B1 * 3/2004 Hester ..... B66B 9/0846 198/321
8,360,336 B2 * 1/2013 Luckett ..... F16H 55/26 238/123
9,085,367 B2 * 7/2015 Steinbeck ..... B64D 11/0696
11,155,443 B2 * 10/2021 Geurts ..... B66B 9/0846
2004/0238286 A1 * 12/2004 Vroegindeweij ..... B66B 9/0846 187/277
2006/0117984 A1 * 6/2006 Carlsen ..... B66B 9/0846 105/29.1
2011/0024237 A1 * 2/2011 Vroegindeweij ..... B66B 9/0838 187/201
2013/0299280 A1 * 11/2013 Friedrich ..... B64D 11/0007 187/245
2015/0375965 A1 * 12/2015 Awerbuch ..... B66B 9/0815 187/201
2016/0236906 A1 * 8/2016 Horton ..... B66B 9/0846
2020/0290844 A1 * 9/2020 Vroegindeweij ..... B66B 9/0815
2020/0361748 A1 * 11/2020 Vroegindeweij ..... B66B 7/023

OTHER PUBLICATIONS

Written Opinion of the International Searching Authority dated May 31, 2019 issued in connection with International Application No. PCT/NL2018/050789 with (5 pages total).
International Preliminary Report on Patentability Chapter II dated Mar. 17, 2020 issued in connection with International Application No. PCT/NL2018/050789 with (17 pages total).

* cited by examiner

RACK FOR A STAIRWAY GUIDE, AND A METHOD OF PROVIDING A STAIRWAY GUIDE COMPRISING A RACK

CROSS REFERENCE TO RELATED APPLICATIONS

This national stage non-provisional utility application claims the benefit of and priority to WIPO application No. PCT/NL2018/050789, filed Nov. 26, 2018, which claims priority to Netherlands Application Serial No. NL2019972, filed Nov. 24, 2017, the entire contents of both applications are hereby incorporated herein by reference.

FIELD

The present invention relates to a rack for a stairway guide, wherein the rack comprises a bendable strip body.

BACKGROUND

U.S. Pat. No. 5,641,040A discloses a flexible track according to the preamble that can be bent easily in a vertical plane. It comprises at one side indentations for a driving wheel and at an opposite side indentations that allow the track to be bent in vertical plane.

Stairlifts are devices for transporting a person between two floors of a building, for example along a flight of stairs of a building lacking an elevator such as a home. The stairlift comprises a stairway guide (rail) and a motorized carriage capable of moving along the stairway guide. To move a person along the inclined stairway guide, the carriage may comprise a friction roll to engage the surface of the stairway guide. Being dependent on friction, this is not as reliable as the alternative which is a stairway guide comprising a rack. With a toothed rack, the carriage can be moved up and down along an inclined stairway guide reliably but it has a disadvantage that curves, i.e. changes in inclination and/or bends (left or right), are not easily accommodated. Also, the toothed track is expensive.

SUMMARY

It is an object of the present invention to provide a track that reduces at least one of the above problems.

To this end, a rack according to the preamble is characterized in that said bendable strip body comprises a first main side and a second main side, the first main side being provided with a series of equidistant engagement elements, each element being chosen from i) a hole, and ii) a protrusion, and two longitudinal sides, wherein the strip body comprises a series of indentations at both longitudinal sides of the strip body.

Such a track can be provided to a stairway guide body with its second main side facing the stairway guide body, usually the upper surface of a stairway guide body. Advantageously, the strip body is provided in a groove of a stairway guide body, said groove determining the curvature of the strip body. An example of a suitable stairway guide body comprising a groove is disclosed in EP3153453.

Being in the form of a strip, the rack can be bent up and down easily to accommodate for the curves of a stairway guide body.

The indentations allow the strip body to be bent sideways (i.e. in the plane of the main plane), to accommodate for left or right bends of the stairway guide. The indentations will advantageously be tapered indentations, flaring out towards the longitudinal sides of the strip body. The area between two adjacent indentations may be designated as a wing.

The indentations of the strip body can be manufactured using a punching technique, e.g. from stainless steel. It is possible to create holes as the engagement elements in the same operation.

The strip body can be manufactured from a strip or plate using any suitable technique, such as molding or by machining such as water jet cutting, laser cutting etc. For reasons of cost a punching technique is advantageous. The strip body is for example made of stainless steel.

In a typical case of a rack, the elements of the series of equidistant engagement elements will be either holes or protrusions, although a combination is possible, for example alternating holes and protrusions.

According to a favourable embodiment, the elements of the strip body are holes and the indentations comprise blind ends, said blind ends being located in the longitudinal direction of the strip body halfway between two adjacent holes.

Thus the holes are at least somewhat protected against deformation when the strip body is bent to accommodate for the curvature of a stairway guide body, in particular left or right bends.

According to a favourable embodiment, the indentations are defined by edges of the strip body, at least one of said edges comprising a shoulder.

Preferably both edges comprise a shoulder at opposite locations. The shoulder or shoulders are useful as stops for a screw used to mount the track to a stairway guide body with the screw at a defined distance from the centerline of the strip body.

According to a favourable embodiment, the elements comprise a wall section adjacent to the first main side, said wall section being inclined at an angle of less than 30 degrees to the centerline of the element.

Being substantially or completely parallel to the center line of the element, such an element will provide a very secure grip for a driving wheel (body of revolution) of the carriage, said driving wheel comprising complementary elements for engaging the elements of the track. The wall section is for example substantially cylindrical. A driving wheel provided with protrusions (knobs) to engage the holes of the rack, will preferably comprise tapered distal ends to ensure proper engagement of the protrusions with the hole and accommodate for curves/bends or knicks.

Protrusions preferably have conical distal ends to facilitate being received by holes, in particular in case of a non-linear rack.

It is preferred that the angle is at least 5 degrees.

Finally, the present invention relates to a method of providing a stairway guide, wherein a stairway guide body is provided with a rack, wherein the rack is a rack according to any of the claims 1 to 4.

The strip body may be glued with its second main side to the stairway guide body, wherein the wings (areas between indentations) provide sufficient surface area. However, it is preferred that fasteners such as screws or screws are used.

According to a favourable embodiment, a stairway guide comprises a stairway guide body comprising at least one deviation from straight chosen from a turn or knick, wherein the rack is bent to accommodate for the deviation and attached to the guiderail body.

The strip body may be used to engage the driving wheel both in turns (left or right bends) or in knicks (inclining with the rack at a concave side of the stairway guide body; or leveling with the rack at concave side of the stairway guide body.

According to a favourable embodiment, the stairway guide body comprises a material comprising aluminium or plastic, and the rack is mounted using self-tapping screws.

Preferably the rack comprises shoulders to define the location of het screws.

BRIEF DESCRIPTION OF THE DRAWINGS

The present invention will now be illustrated with reference to the drawing where

FIG. 1 shows a cut-out sideview of a stairlift carriage 180 on a stairway guide 150.

DETAILED DESCRIPTION

Figure 1:
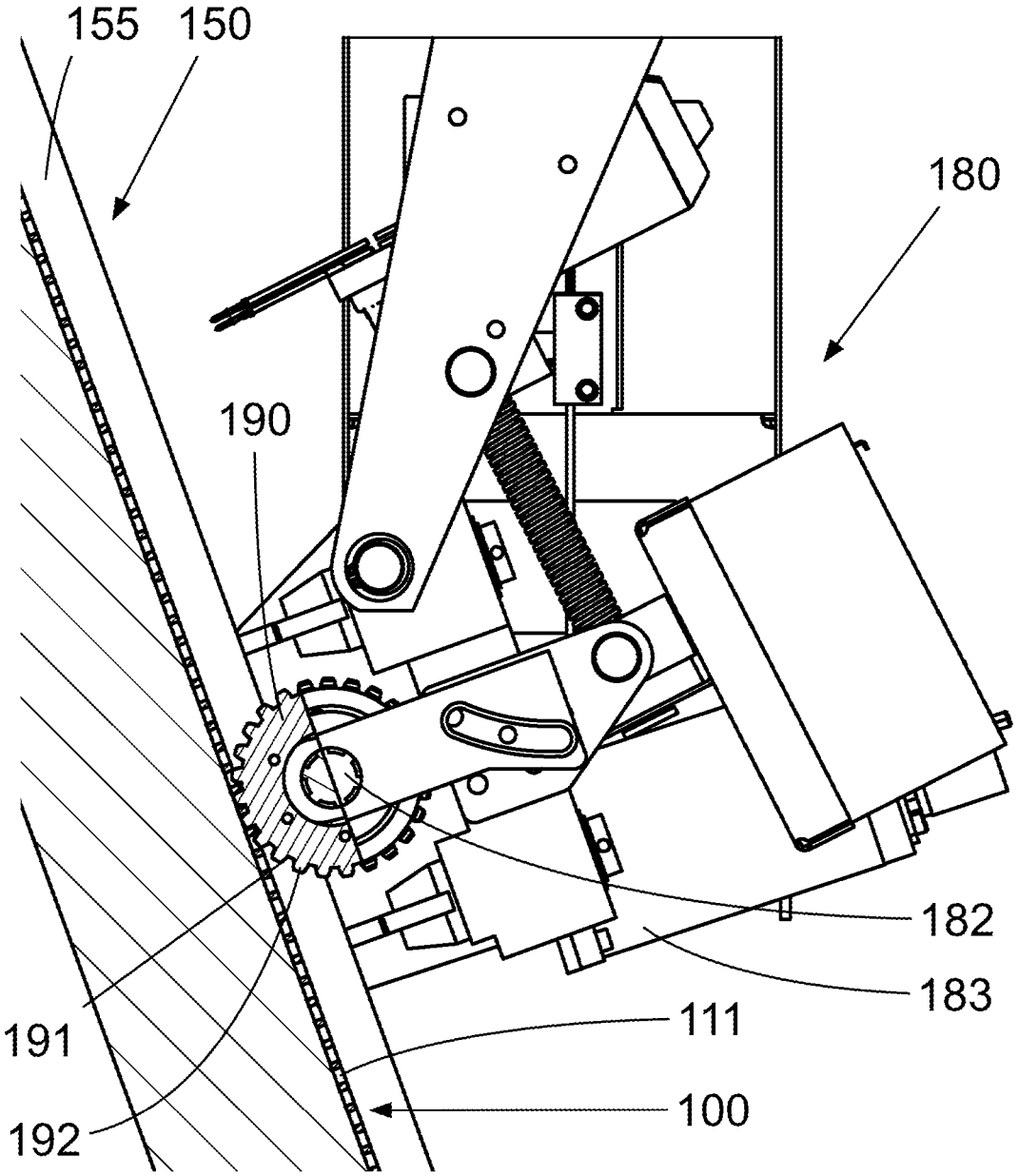
FIG. 1 shows a cut-out sideview of a stairlift carriage on a stairway guide.

The stairway guide 150 comprises a stairway guide body 155 and a rack 100 fixed to said stairway guide body 155. The rack 100 comprises a plurality of holes 111, here through-holes 111.

The stairlift carriage 180 comprises a driven wheel 190 mounted on an axle 182 and driven by a motor 183 via a right-angled transmission. The driven wheel 190 (pinion wheel) comprises a tread 191, said tread being provided with spaced-apart knobs 192.

When the wheel 190 is driven by motor 183, the knobs 192 of the wheel 190 are received by the through-holes 111. This allows the stairlift carriage 180 to move safely along the stairway guide 150.

Figure 2:
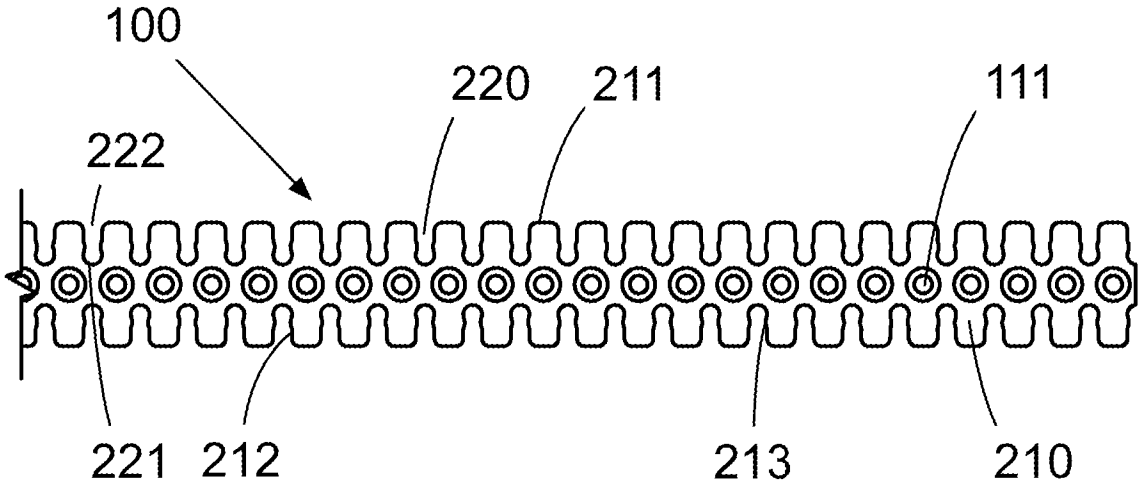
FIG. 2 shows a top view of a section of a rack according to the invention.

FIG. 2 shows a top view of a section of a rack 100 according to the invention. The rack 100 is made of a metal strip and comprises a strip body 210 with two opposite longitudinal sides 211 provided with a series of indentations 220 at both longitudinal sides 211 of the strip body 210.

The indentations 220 comprise blind ends 221 away for the longitudinally extending sides 211 and open ends 222 opening up at the longitudinally extending sides 211. The indentations 220 are defined by edges 212 of the strip body 210, both edges 212 of an indentation 220 that face each other providing a shoulder 213 which serve as a stop for a screw (not shown) which are convenient if is desired to fix the rack 100 to the stairway guide 150 using self-tapping screws.

The rack 100 as shown in FIG. 2 is straight but can be bent to a desired shape. When it is bent, the through-holes 111 are at least to some extent protected from excessive deformation that might otherwise jeopardise reliable engagement of the wheel 190 by the stairlift carriage 180, because in this preferred embodiment the blind ends 221 are from a longitudinal point of view halfway between adjacent through-holes 111.

To reliably receive the knobs 192 of the wheel 190, the through-holes 111 are tapered through-holes as will be discussed with reference to FIG. 4.

Figure 3A:
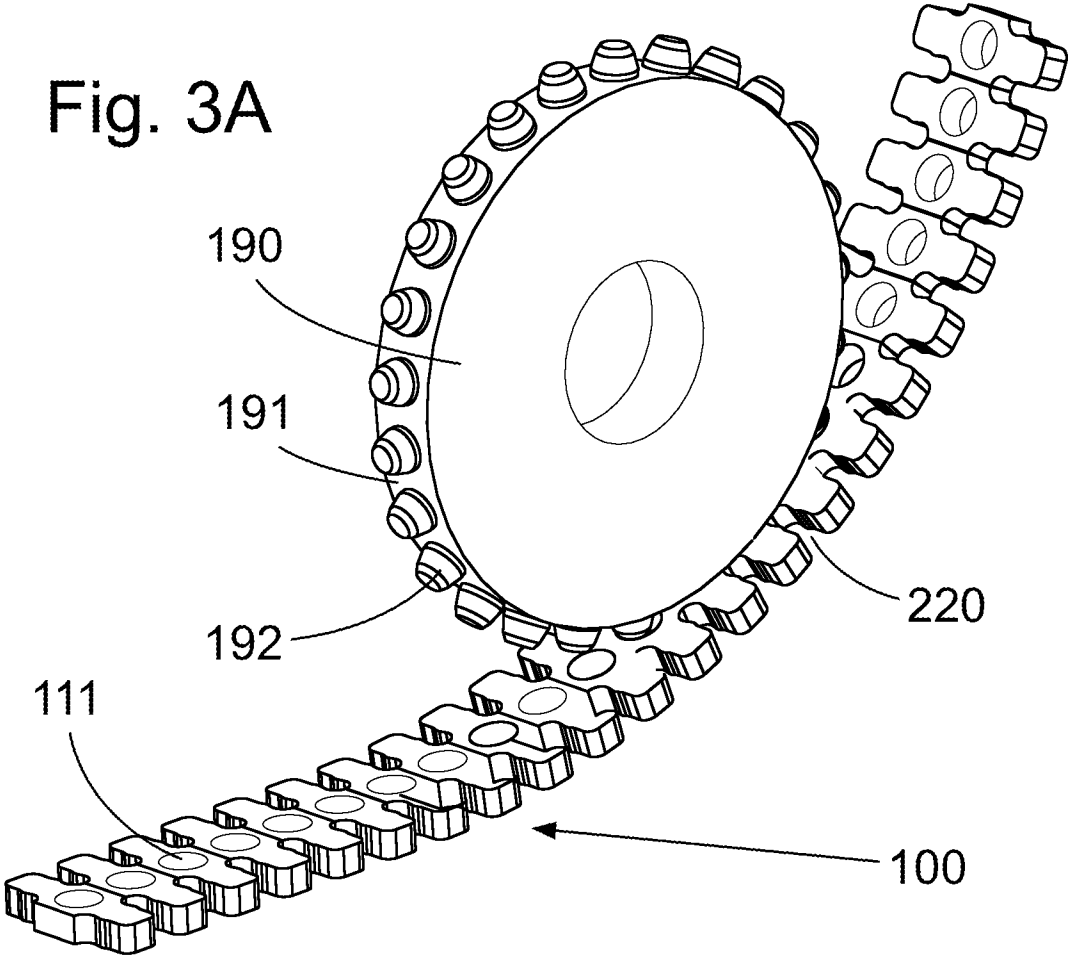
FIG. 3*a* shows a wheel of the stairlift carriage of FIG. 1 on a rack with changing inclination.

FIG. 3A shows the wheel 190 of the stairlift carriage 180 of FIG. 1 on a rack 100 with changing inclination.

Figure 3B:
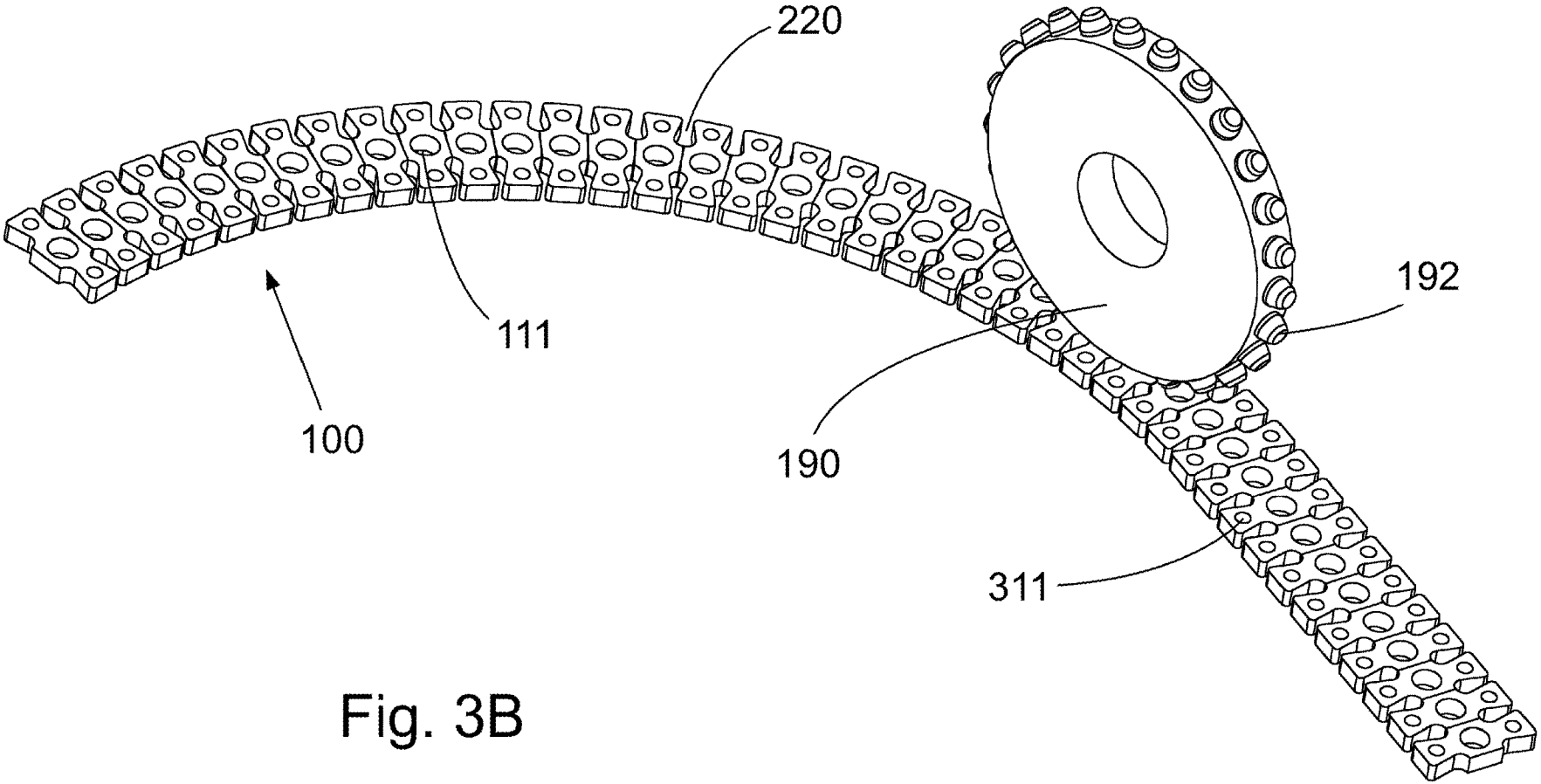
FIG. 3*b* shows a wheel of the stairlift carriage of FIG. 1 on a curved rack.

FIG. 3B shows a wheel 190 of the stairlift carriage 180 of FIG. 1 on a curved rack 100.

In the embodiments shown in FIG. 3A and FIG. 3B, the rack 100 comprises further holes 311 for sturdily fixing the rack 100 to the stairway guide body 155.

Figure 4:
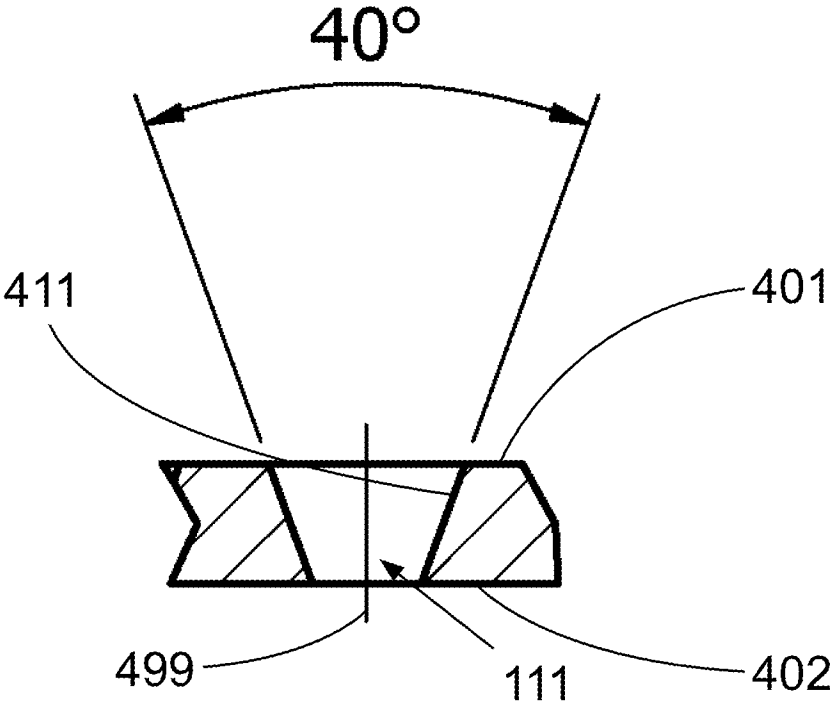
FIG. 4 shows a cross-sectional view through the rack of FIG. 2.

FIG. 4 shows a cross-sectional view through the rack of FIG. 2. The rack 100 comprises a first main side 401 and a second main side 402. The second main side 402 will face the stairway guide body 155 after fixing the rack 100 to the stairway guide body 155.

To reliably receive the knobs 192 of the wheel 190, the through-holes 111 are tapered through-holes 111, with wall sections 411 adjacent to the first main side 401, said wall sections 411 being an angle of 20° to the centerline 499. This allows the knobs 192 of the wheel 190 to be received reliably in by the through-holes 111 of the rack 100 even in case there is a deviation from the linear in the rack 100 fixed to a stairway guide 150. The shallow angle allows for a firm grip of the wheel 190 to the track 100.

The invention can be varied within the scope of the appended claims. For example, instead of through-holes 111 the rack 100 may comprise protruding elements, in which case the wheel 190 should comprise complementary recesses. Such a rack may be manufactured by providing the rack of FIG. 2 with pins which will preferably be tapered. It is not impossible to have a rack with both holes and protrusions with a complementary wheel 190.

The invention claimed is:

1. A rack for a stairway guide, wherein the rack comprises a bendable strip body;

wherein said bendable strip body comprises a first main side and a second main side, the first main side being provided with a series of equidistant engagement elements, wherein said elements of the strip body are holes, and two longitudinal sides, wherein the strip body comprises a series of indentations at both longitudinal sides of the strip body, wherein the indentations comprise blind ends, said blind ends being located in the longitudinal direction of the strip body halfway between two adjacent holes.

2. The rack according to claim 1, wherein the indentations are defined by edges of the strip body, at least one of said edges comprising a shoulder.

3. The rack according to claim 2, wherein the elements comprise a wall section adjacent to the first main side, said wall section being inclined at an angle of less than 30 degrees to the centerline of the element.

4. A method of providing a stairway guide, wherein a stairway guide body is provided with a rack, wherein the rack is a rack according to claim 3.

5. The method according to claim 4, wherein a stairway guide comprises a stairway guide body comprising at least one deviation from straight chosen from a turn or knick, wherein the rack is bent to accommodate for the deviation and attached to the guiderail body.

6. The method according to any of the claim 5, wherein the stairway guide body comprises a material comprising aluminium or plastic, and the rack is mounted using self-tapping screws.

* * * * *